US007485194B2

(12) United States Patent
Mega et al.

(10) Patent No.: US 7,485,194 B2
(45) Date of Patent: Feb. 3, 2009

(54) HIGH TENSILE HOT-ROLLED STEEL SHEET EXCELLENT IN RESISTANCE TO SCUFF ON MOLD AND IN FATIGUE CHARACTERISTICS

(75) Inventors: Tetsuya Mega, Tokyo (JP); Kei Sakata, Tokyo (JP)

(73) Assignee: JFE Steel Corporation (JP)

( * ) Notice: Subject to any disclaimer, the term of this patent is extended or adjusted under 35 U.S.C. 154(b) by 283 days.

(21) Appl. No.: 10/479,637

(22) PCT Filed: May 23, 2002

(86) PCT No.: PCT/JP02/05024

§ 371 (c)(1),
(2), (4) Date: Jun. 14, 2004

(87) PCT Pub. No.: WO02/101099

PCT Pub. Date: Dec. 19, 2002

(65) Prior Publication Data

US 2004/0231393 A1 Nov. 25, 2004

(30) Foreign Application Priority Data

Jun. 7, 2001 (JP) ..... 2001-171955
May 9, 2002 (JP) ..... 2002-133843

(51) Int. Cl.
*C22C 38/02* (2006.01)
*C22C 38/04* (2006.01)
*C22C 38/12* (2006.01)

(52) U.S. Cl. ..... 148/320; 148/331; 148/334

(58) Field of Classification Search ..... 148/666, 148/320, 331, 334, 602, 653, 654
See application file for complete search history.

(56) References Cited

U.S. PATENT DOCUMENTS 4,466,842 A * 8/1984 Yada et al. ..... 148/564
6,290,784 B1 * 9/2001 Yasuhara et al. ..... 148/320

FOREIGN PATENT DOCUMENTS

| | | |
|---|---|---|
| EP | 1 195 447 A1 | 4/2002 |
| JP | 07 150291 A | 6/1995 |
| JP | 09 49026 | 2/1997 |
| JP | 09 143612 | 6/1997 |
| JP | 10 176239 | 6/1998 |

OTHER PUBLICATIONS

Computer-generated English translation of Japanese patent 11-100641, Takagi Shusaku et al, Apr. 13, 1999.*

* cited by examiner

*Primary Examiner*—Deborah Yee
(74) *Attorney, Agent, or Firm*—DLA Piper LLP (US)

(57) ABSTRACT

This disclosure proposes a high-strength hot rolled steel sheet having excellent anti-die-galling property and anti-fatigue property, in which the steel sheet has a composition including C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % S: not more than 0.01 mass % and the remainder being substantially Fe and inevitable impurities, and has a steel microstructure containing not less than 55 vol % of ferrite and not less than 10 vol % but not more than 40 vol % of martensite provided that a total of both is not less than 95 vol %, and a ratio ds/dc of an average crystal grain size ds of the ferrite in a surface layer portion of the steel sheet to an average crystal grain size dc of the ferrite in a center portion of the steel sheet is $0.3<ds/dc\leqq1.0$ and a surface roughness is not more than 1.5 μm as an arithmetic mean roughness Ra, as well as a method of producing the same.

2 Claims, No Drawings

HIGH TENSILE HOT-ROLLED STEEL SHEET EXCELLENT IN RESISTANCE TO SCUFF ON MOLD AND IN FATIGUE CHARACTERISTICS

TECHNICAL FIELD

This disclosure relates to a high-strength hot rolled steel sheet having a tensile strength of not less than 590 MPa and excellent anti-die-galling property and anti-fatigue property which is suitable for use mainly in structural parts of automobiles, underbody parts such as a wheel, a rim and a chassis, high-strength parts such as a bumper and a door guard bar, and so on as hot-rolled.

BACKGROUND

Recently, from a viewpoint of the weight reduction of the vehicle body in the automobile, it is demanded to increase the strength in the hot rolled steel sheets which are used in the structural part of the automobile, underbody parts such as a wheel, a rim and a chassis, high-strength parts such as a bumper and a door guard bar, and so on. Above all, such a demand is particularly strong for high-strength steel sheets having a tensile strength of not less than 590 MPa. In addition, the hot rolled steel sheets used in such applications are required to have a good anti-fatigue property. Especially, the underbody parts supporting the weight of the vehicle body are required to have an excellent anti-fatigue property in the bending mode because a large bending deformation is applied to the steel sheet.

In general, as the high-strength steel sheet is high in the yield point and easily causes the springback during the forming, it is considered to hardly provide a given shape by a press work. In order to solve such a problem, therefore, JP-A-55-28375 proposes a steel sheet having an improved shape fixability in which it is made possible to lower the yield point as compared with the degree of the tensile strength by dispersing hard martensite into soft ferrite to form a dual phase microstructure.

However, it is lately desired to further improve the press formability in order to properly cope with the high-strengthening of the steel sheet for the weight reduction of the vehicle body, the common die forming in the parts constituting a vehicle body, the complication of the shape of the parts and the like.

As the press formability is affected by the surface roughness to no small extent, it is examined to adjust the surface roughness to improve the press formability.

A technique for improving the press formability by properly adjusting the surface roughness of the steel sheet as mentioned above is disclosed in, for example, JP-A-6-99202. This technique ensures good frictional characteristics and improves the press formability by adjusting the surface roughness, which is provided by the control of a skin pass rolling, in accordance with the strength of the steel sheet with respect to thin steel sheets produced by the continuous annealing.

However, the technique disclosed in JP-A-6-99202 targets steel sheets having inherently a small surface roughness such as cold rolled steel sheets and surface treated steel sheets, so that there is a problem that it is difficult to apply the above technique to steel sheets having inherently a large surface roughness resulted from the push-in of scale or the like during the rolling such as hot rolled steel sheets.

And also, a technique providing the hot rolled steel sheet suitable for use in applications for working and forming such as a stamping or the like by adjusting the surface roughness of the steel sheet is disclosed in JP-A-9-118918. This technique intends to improve the frictional characteristics and the ductility by rendering the surface roughness of at least one surface of the steel sheet into Ra of not more than 0.8 μm, Rmax of not more than 4.0 μm and Rv/Rmax of not more than 0.7. Moreover, the term "Rv" used herein means a distance from a deepest valley to a center line in a measured length of a profile curve.

However, as this technique intends to improve the workability only by the surface roughness, when the steel sheet obtained by this technique is subjected to the forming accompanied with a large working amount as in an inner plate of the automobile, there is a fear that the die-galling is easily caused in a portion having the large deformation quantity and the cracking is caused therewith.

SUMMARY

We provide a high-strength hot rolled steel sheet having not only an excellent press formability but also an excellent anti-die-galling property and a good anti-fatigue property and having a tensile strength of not less than 590 MPa as well as a method of advantageously producing the same.

We made various studies and obtained the following knowledge.

a) By properly adjusting components in steel and properly controlling conditions for the hot rolling and subsequent cooling conditions is rendered the steel into a dual phase microstructure mainly composed of ferrite and martensite to lower the mechanical characteristics, particularly the yield ratio, whereby in addition to the improvement of the shape fixability, the deformation on the surface layer portion of the steel sheet is facilitated to easily develop an effect of shutting an operating oil during the press forming and hence the anti-die-galling property can be improved.

b) And also, as the arithmetic mean roughness Ra is made small, the friction coefficient in the press forming becomes small, and hence the die-galling is hardly caused in the press forming, and further the notch effect on the surface is reduced to improve the fatigue strength in the bending mode.

c) Furthermore, with respect to the crystal grain size in a thickness direction of the hot rolled steel sheet, by making such a distribution that the crystal grain size in the surface layer portion of the steel sheet is not larger than the crystal grain size in the center portion of the steel sheet, the strength in the surface layer portion of the steel sheet can be made equal to or more than the strength in the center portion of the steel sheet, of producing the high-strength hot rolled steel sheet so that the anti-die-galling property is improved and hence the cracking in the press forming and the occurrence of surface defect can be prevented.

Thus, we provide:

1. A high-strength hot rolled steel sheet having excellent anti-die-galling property and anti-fatigue property, characterized in that the steel sheet has a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and the remainder being substantially Fe and inevitable impurities, and has a steel microstructure containing not less than 55 vol % of ferrite and not less than 10 vol % but not more than 40 vol % of martensite provided that a total of both is not less than 95 vol %, and a ratio ds/dc of an average crystal grain size ds of the ferrite in a region ranging from a surface of the steel sheet to a position corresponding to a quarter-thickness in the steel sheet to an average crystal grain size dc of the ferrite in a region ranging from the position corresponding to the quarter-thickness in the steel sheet to a center of a thickness in the steel sheet is $0.3<ds/dc\leqq1.0$, and a surface roughness is not more than 1.5 μm as an arithmetic mean roughness Ra.

2. A high-strength hot rolled steel sheet having excellent anti-die-galling property and anti-fatigue property, characterized in that the steel sheet has a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass %, and further containing at least one selected from Cr: not more than 0.3 mass %, Ca: not less than 0.001 mass % but not more than 0.005 mass % and REM: not less than 0.001 mass % but not more than 0.005 mass % and the remainder being substantially Fe and inevitable impurities, and has a steel microstructure containing not less than 55 vol % of ferrite and not less than 10 vol % but not more than 40 vol % of martensite provided that a total of both is not less than 95 vol %, and a ratio ds/dc of an average crystal grain size ds of the ferrite in a region ranging from a surface of the steel sheet to a position corresponding to a quarter-thickness in the steel sheet to an average crystal grain size dc of the ferrite in a region ranging from the position corresponding to the quarter-thickness in the steel sheet to a center of a thickness in the steel sheet is $0.3<ds/dc\leqq1.0$, and a surface roughness is not more than 1.5 μm as an arithmetic mean roughness Ra.

3. A method of producing a high-strength hot rolled steel sheet having excellent anti-die-galling property and anti-fatigue property, which comprises using as a starting material a steel slab having a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and the remainder being substantially Fe and inevitable impurities, subjecting to a hot rolling under a condition that a final deformation temperature is not lower than ($Ar_3$−100° C.) but lower than $Ar_3$ as a surface temperature, cooling to not higher than 750° C. but not lower than 700° C., keeping at this temperature range for not less than 2 seconds but not more than 30 seconds, cooling, and then coiling at not higher than 650° C. but not lower than 500° C.

4. A method of producing a high-strength hot rolled steel sheet having excellent anti-die-galling property and anti-fatigue property, which comprises using as a starting material a steel slab having a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and further containing at least one selected from Cr: not more than 0.3 mass %, Ca: not less than 0.001 mass % but not more than 0.005 mass % and REM: not less than 0.001 mass % but not more than 0.005 mass % and the remainder being substantially Fe and inevitable impurities, subjecting to a hot rolling under a condition that a final deformation temperature is not lower than ($Ar_3$−100° C.) but lower than $Ar_3$ as a surface temperature, cooling to not higher than 750° C. but not lower than 700° C., keeping at this temperature range for not less than 2 seconds but not more than 30 seconds, cooling, and then coiling at not higher than 650° C. but not lower than 500° C.

5. A method of producing a high-strength hot rolled steel sheet having excellent anti-die-galling property and anti-fatigue property, which comprises using as a starting material a steel slab having a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and the remainder being substantially Fe and inevitable impurities, subjecting to a hot rolling under a condition that a slab heating temperature is not higher than 1100° C. and a final deformation temperature is not lower than ($Ar_3$−100° C.) but not higher than ($Ar_3$+50° C.) as a surface temperature, cooling at a cooling rate of not less than 40° C./s to not higher than 750° C. but not lower than 700° C., keeping at this temperature range for not less than 2 seconds but not more than 30 seconds, cooling, and then coiling at not higher than 650° C. but not lower than 500° C.

6. A method of producing a high-strength hot rolled steel sheet having excellent anti-die-galling property and anti-fatigue property, which comprises using as a starting material a steel slab having a composition comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and further containing at least one selected from Cr: not more than 0.3 mass %, Ca: not less than 0.001 mass % but not more than 0.005 mass % and REM: not less than 0.001 mass % but not more than 0.005 mass % and the remainder being substantially Fe and inevitable impurities, subjecting to a hot rolling under a condition that a slab heating temperature is not higher than 1100° C. and a final deformation temperature is not lower than ($Ar_3$−100° C.) but not higher than ($Ar_3$+50° C.) as a surface temperature, cooling at a cooling rate of not less than 40° C./s to not higher than 750° C. but not lower than 700° C., keeping at this temperature range for not less than 2 seconds but not more than 30 seconds, cooling, and then coiling at not higher than 650° C. but not lower than 500° C.

DETAILED DESCRIPTION

At first, the reason of limiting the composition of the starting material to the above range will explained.

C: not less than 0.02 mass % but not more than 0.2 mass %

C is an element useful for improving the tensile strength, and C content is required to be at least 0.02 mass % in order to obtain a desired tensile strength. However, when the C content exceeds 0.2 mass %, CO gas is generated at an interface between the scale and the base iron to cause the occurrence of scale flaw at the rolling stage and the arithmetic mean roughness Ra becomes larger but also the weldability is drastically deteriorated. Therefore, the C content is limited to a range of not less than 0.02 mass % but not more than 0.2 mass %. Preferably, it is not less than 0.02 mass % but not more than 0.12 mass %.

Si: not less than 0.2 mass % but not more than 1.2 mass %

Si is an element being large in the solid solution hardening and contributing to increase the strength of the steel without damaging the yield ratio and the balance between the strength and the elongation. And also, it is an element essential for the formation of the mixed microstructure by activating a transformation from γ to α to promote C enrichment into γ phase and also effectively contributes to the cleaning of the steel as a deoxidizing element in the steel making. Further, it is an essential element in steel for controlling the formation of a carbide such as $Fe_3C$ or the like to facilitate the formation of the dual phase microstructure consisting of ferrite and martensite and lower the yield ratio. Moreover, it has an action that it is solid-soluted into ferrite to increase the tensile strength and strengthen grains of soft ferrite to thereby improve the anti-fatigue property.

These effects of Si are sufficiently developed in an amount of not less than 0.2 mass %, but when the amount exceeds 1.2 mass %, the above effects are peaked out and also the non-peeling scale is formed on the steel surface to bring about the occurrence of the flaw on the surface and the deterioration of the surface roughness. In addition, it also deteriorates the phosphatability. Therefore, the Si content is limited to a range of not less than 0.2 mass % but not more than 1.2 mass %. Preferably, it is not less than 0.6 mass % but not more than 1.2 mass %.

Mn: not less than 1.0 mass % but not more than 3.0 mass %

Mn is a useful element not only effectively contributing to the improvement of the strength of the steel but also improving the hardenability, and particularly it is an effective element for rendering the second phase into the microstructure comprising the martensite phase. Moreover, it has an effect for precipitating the solid-soluted S, which causes the brittleness fracture in the hot working, as MnS to defuse it. These effects can not be expected when Mn content is less than 1.0 mass %. While, when the Mn content exceeds 3.0 mass %, it has various bad influences that the scale is stabilized on the steel surface not only to generate the surface flaw and make the surface roughness too large but also to deteriorate the weldability and the like. Therefore, the Mn content is limited to a range of not less than 1.0 mass % but not more than 3.0 mass %. Preferably, it is not less than 1.0 mass % but not more than 2.5 mass %.

Mo: not less than 0.1 mass % but not more than 1.0 mass %

Mo is a useful element for not only contributing to the improvement of the strength of the steel but also improving the hardenability to facilitate the formation of the microstructure comprised of ferrite and martensite and lowering the yield ratio to improve the anti-die-galling property. And also, Mo is the element having an effect that the crystal grains in steel are fined to improve the balance between the strength and the elongation but also reduce the surface roughness. In the hot rolled steel sheet, the crystal grain size in the surface layer portion of the steel sheet generally tends to become larger as compared with the crystal grain size in the center portion of the steel sheet. However, $Ar_3$ transformation point is raised by adding Mo and further the rolling is carried out just above the $Ar_3$ transformation point, whereby there can be prevented that the crystal grain size of the surface layer portion of the steel sheet becomes larger as compared with that of the center portion of the steel sheet. That is, it is tendentious that the surface layer portion of the steel sheet can be rolled in a dual phase region of α and γ and the center portion of the steel sheet can be rolled in a γ region, so that the crystal grain in the surface layer portion of the steel sheet can be made finer as compared with that in the center portion of the steel sheet. Therefore, the anti-die galling property can be improved and also the anti-fatigue property in the bending mode can be improved.

In order to develop these effects, Mo content is necessary to be not less than 0.1 mass %. However, when Mo content exceeds 1.0 mass %, bainite is formed, which further brings about the bad influence such as the deterioration of the weldability or the like. Therefore, the Mo content is limited to a range of not less than 0.1 mass % but not more than 1.0 mass %.

Al: not less than 0.01 mass % but not more than 0.1 mass %

Al is a useful element as a deoxidizing agent. However, when Al content is less than 0.01 mass %, the addition effect becomes poor. While, when the Al content exceeds 0.1 mass %, the effect is saturated and also the increase of the cost and the embrittlement of the steel sheet are caused. Therefore, the Al content is limited to a range of not less than 0.01 mass % but not more than 0.1 mass %.

P: not more than 0.03 mass %

Since P is an element deteriorating the weldability and causing the embrittlement of the grain boundary, it is preferable to reduce the content as far as possible. When the P content exceeds 0.03 mass %, the deterioration of the weldability or the like appears remarkably, so that the upper limit of the P content is 0.03 mass %. Moreover, the lower limit of the P content capable of reducing without causing the remarkable increase of the steel-making cost in the existing refinement technique is about 0.005 mass %.

S: not more than 0.01 mass %

Since S is an element considerably deteriorating the hot workability and the tenacity, it is preferable to reduce the content as far as possible. When the S content exceeds 0.01 mass %, the deterioration of the hot workability or the like appears remarkably and there is a fear of deteriorating the weldability within the above range. Therefore, the upper limit of the S content is 0.01 mass %. More preferably, the Si content is not more than 0.007 mass %. Moreover, the lower limit of the S content capable of reducing without causing the remarkable increase of the steel-making cost in the existing refinement technique is about 0.001 mass %.

Although the above is explained with respect to the essential elements, the following elements may be properly included.

Cr: not more than 0.3 mass %

Cr is a useful element for improving the hardenability but also contributing to increase the strength of the steel as a solid-soluted element. And also, Cr also contributes to the formation of the dual phase microstructure of the ferrite and the martensite and is a useful element for controlling the pearlite transformation to stabilize the austenite phase as a second phase during the hot rolling and ensure the martensite after the hot rolling.

In order to obtain these effects, Cr content is preferable to be not less than 0.1 mass %. However, when the Cr content exceeds 0.3 mass %, a stable Cr oxide phase is formed on the steel surface to obstruct the descaling property, and the surface roughness of the steel sheet becomes larger and not only phosphatability is remarkably deteriorated but also the weldability is adversely affected and further the cost increases. Therefore, the Cr content is limited to not more than 0.3 mass %.

Ca: not less than 0.001 mass % but not more than 0.005 mass %

Ca has an action of fining the sulfide form and is a useful element contributing to improve the elongation and the anti-fatigue property.

In order to develop the effect, the Ca content is required to be not less than 0.001 mass %. However, when the Ca content exceeds 0.005 mass %, the effect is saturated and the cost is unnecessarily increased and the cleanliness of steel is inversely deteriorated. Therefore, the Ca content is limited to a range of not less than 0.001 mass % but not more than 0.005 mass %.

REM: not less than 0.001 mass % but not more than 0.005 mass %

REM (rare earth element) has an action of fining the sulfide form and is a useful element contributing to improve the elongation and the anti-fatigue property likewise Ca. In order to develop the effect, the REM content is required to be not less than 0.001 mass %. However, when the REM content exceeds 0.005 mass %, the effect is saturated and the cost is unnecessarily increased and the cleanliness of steel is inversely deteriorated. Therefore, the REM content is limited to a range of not less than 0.001 mass % but not more than 0.005 mass %.

Moreover, the remainder other than the above elements is Fe and inevitable impurities.

Next, reasons for limiting the microstructure, the average crystal grain size and the surface roughness of the high-strength steel sheet will be explained, respectively.

The microstructure of the steel forms the ferrite as a main phase by rendering the ferrite into not less than 55 vol % and produces the martensite within a range of not less than 10 vol % but not more than 40 vol %. Thus, the yield ratio is lowered to facilitate the deformation at the surface layer portion of the steel sheet and also the pressure at a contact portion between the mold and the steel sheet in the press forming is lowered, whereby the anti-die galling property can be improved.

In other words, when the ferrite is less than 55 vol %, the above effects can not be obtained. And also, in order to obtain the above effects, the martensite is also required to be not less than 10 vol %. However, when it exceeds 40 vol %, the effect is saturated and the strength is remarkably increased to lower the ductility.

Moreover, in order to get the above effect, as mentioned above, it is preferable to form a dual phase microstructure of the ferrite and the martensite containing the ferrite as a main phase. However, bainite and the like can be included up to 5 vol % as the other microstructure.

Therefore, the total amount of the ferrite and the martensite is not less than 95 vol %. Moreover, when the total amount of the ferrite and the martensite is less than 95 vol %, the influence of the mixed other phase becomes larger and hence it is difficult to sufficiently obtain the above effects by the ferrite and the martensite.

With respect to the average crystal grain size, it is important that the ratio ds/dc of the average crystal grain size ds of the ferrite in a region ranging from the surface of the steel sheet to a position corresponding to a quarter-thickness in the steel sheet, that is, in the surface layer portion of the steel sheet to the average crystal grain size dc of the ferrite in a region ranging from the position corresponding to the quarter-thickness in the steel sheet to a center of the thickness, that is, in the center portion of the steel sheet is more than 0.3 but not more than 1.0. That is, it is important to control the distribution in the thickness direction of the crystal grains of the hot rolled steel sheet so as not to make larger the crystal grain size in the surface layer portion of the steel sheet than that in the center portion of the steel sheet. Moreover, the term "a position corresponding to a quarter-thickness in the steel sheet" used herein means a position located inside the steel sheet by a quarter of the overall thickness from the surface of the steel sheet.

In general, the strength of the steel is inversely proportional to the crystal grain size by means of the Hall-Petch relationship. To this end, by controlling the crystal grain size in the surface layer portion of the steel sheet so as not to make larger than the crystal grain size in the center portion of the steel sheet can be made the strength in the surface layer portion of the steel sheet equal to or larger than the strength in the center portion of the steel sheet. As a result, the occurrences of the cracking and the surface defect in the press forming can effectively be prevented without causing the die-galling between the steel sheet and the mold.

That is, when the ratio ds/dc of the above average crystal grain sizes is not more than 0.3, the crystal grains in the center portion of the steel sheet are remarkably coarsened and hence the sufficient strength of the steel sheet is not obtained, and also the difference in the strength between the surface layer portion of the steel sheet and the center portion of the steel sheet becomes larger, and the die-galling due to the mold in the press forming is increased to lower the anti-die-galling property.

On the other hand, when the ratio ds/dc exceeds 1.0, the strength in the surface layer portion of the steel sheet is lowered to bring about the lowering of the anti-die-galling property.

Furthermore, with respect to the surface roughness, the surface roughness is necessary to be not more than 1.5 μm as an arithmetic mean roughness Ra. Moreover, the term "surface roughness" used herein means a surface roughness in a direction of 90° with respect to the hot rolling direction. When Ra exceeds 1.5 μm, both the anti-die-galling property and the anti-fatigue property deteriorate and even if the microstructure of the steel sheet is adjusted as mentioned above, the effects for improving the anti-die-galling property and the anti-fatigue property can not be obtained. Moreover, the preferable range of the surface roughness is not less than 0.8 μm but not more than 1.2 μm as the arithmetic mean roughness Ra.

Next, the production method will be explained.

By using as a starting material a steel slab having the above composition as a preferable composition, the hot rolling is conducted under a condition that the final deformation temperature is not lower than ($Ar_3$ transformation point−100° C.) but lower than $Ar_3$ transformation point as a surface temperature. By rendering the final deformation temperature into the above temperature range, in a final stand of the finish rolling, the surface layer portion of the steel sheet is mostly rolled in the dual phase region of α and γ, while the center portion of the steel sheet is mostly rolled in the γ region, and hence the crystal grain size in the surface layer portion of the steel sheet can be adjusted so as not to make larger than the crystal grain size in the center portion of the steel sheet. As a result, not only the anti-die-galling property can be improved but also the anti-fatigue property in the bending mode can be improved. Moreover, a more preferable range of the final deformation temperature is a range of not lower than ($Ar_3$ transformation point−50° C.) but lower than $Ar_3$ transformation point as a surface temperature.

Moreover, the thickness of the hot rolled steel sheet is not especially limited, but is preferable to be not less than 2.0 mm but not more than 5.0 mm.

After the above hot rolling, the steel sheet is cooled to a temperature range of not higher than 750° C. but not lower than 700° C., kept at this temperature range for not less than 2 seconds but not more than 30 seconds, cooled and then coiled at not higher than 650° C. but not lower than 500° C.

By cooling to the temperature range of not higher than 750° C. but not lower than 700° C. can be promoted the ferrite transformation and also the enrichment of C into the γ phase is promoted to facilitate the formation of the martensite phase. When cooling to a temperature of higher than 750° C. or to a temperature of lower than 700° C., the ferrite transformation is delayed by deviating from a precipitation nose of the ferrite phase in the course of a moderate cooling, i.e. in the retention at the temperature region of not higher than 750° C. but not lower than 700° C. and hence the dual phase separation of α and γ is not promoted. Moreover, a preferable range of the cooling temperature is not higher than 730° C. but not lower than 720° C. And also, the cooling rate does not need to be especially limited, but it is preferable to be not less than 15° C./s but not more than 40° C./s as an average cooling rate.

Further, after the cooling to the temperature range of not higher than 750° C. but not lower than 700° C., the retention at this temperature range for not less than 2 seconds but not more than 30 seconds contributes to the promotion of the dual phase separation of α and γ, which is important for obtaining the finally targeted dual phase microstructure of the ferrite and the martensite. When the retention time is less than 2 seconds, the dual phase separation from γ to α does not proceed, and the enrichment of C into γ is not sufficient and the martensite transformation of the second phase hardly occurs in the subsequent coiling step, and hence the target microstructure is not obtained. While, when the retention time exceeds 30 seconds, the ferrite transformation proceeds excessively, and the dual phase separation from γ to α is promoted to make large the difference in the crystal grain size between the surface layer portion of the steel sheet and the center portion of the steel sheet. Also, the pearlite transformation is started to produce the pearlite, so that the formation of the martensite is considerably suppressed and hence a sufficient amount of martensite is not formed to bring about the increase of the yield ratio and the lowering of the press formability. Moreover, the retention treatment may be either a retaining treatment keeping at a constant temperature or a so-called moderate cooling treatment slowly cooling within the temperature range such as air cooling or the like. More preferably, the retention time is not less than 5 seconds but not more than 10 seconds.

After the above retention, the steel sheet is cooled and coiled at not higher than 650° C. but not lower than 500° C. to form a hot rolled steel sheet. Moreover, the cooling rate does not need to be limited, but it is preferable to be not less than 15° C. but not more than 40° C./s. The reason why the coiling temperature is limited to not higher than 650° C. but not lower than 500° C. is based on the following fact. When it exceeds 650° C., the pearlite is produced to considerably suppress the formation of the martensite and hence the target microstructure can not be obtained. In addition, the scale growth after the coiling occurs, and the pickling property is poor and the roughness in the surface of the base iron becomes larger due to the excessive oxidization. On the other hand, when it is lower than 500° C., the steel sheet easily renders into an undulating shape due to the lowering of the coiling temperature and the control therefor becomes difficult. Also, the surface flaw easily occurs in the coiling step and hence the arithmetic mean roughness Ra becomes too large. Furthermore, the strength is remarkably increased to bring about the remarkable deterioration of the press formability and there may be caused a case that a large amount of the bainite phase is included in the microstructure, so that the formation of the martensite is restrained to bring about the increase of the yield ratio. A preferable range of the coiling temperature is not higher than 600° C. but not lower than 550° C. Moreover, the cooling rate after the coiling is not especially limited, but the cooling in air is sufficient because sufficient enrichment of C into the austenite phase is achieved by coiling at the above temperature range.

As mentioned above, by adopting a two-stage cooling method that the steel sheet after rolling is subjected to the moderate cooling process keeping at not higher than 750° C. but not lower than 700° C. for not less than 2 seconds but not more than 30 seconds and then coiled at not higher than 650° C. but not lower than 500° C., the dual phase separation of α and γ is promoted to promote the formation of the dual phase microstructure of α and γ.

Moreover, when the final deformation temperature during hot rolling is not lower than ($Ar_3$−100° C.) but lower than $Ar_3$ as a surface temperature as mentioned above, the slab heating temperature before the hot rolling is not especially limited and is sufficient to be not lower than 1100° C. but not higher than 1250° C. as a usual range.

On the other hand, it is further found that when the slab heating temperature is made as low as not higher than 1100° C. and the cooling rate to not higher than 750° C. but not lower than 700° C. after the hot rolling is made as high as not less than 40° C./s, even if the final deformation temperature is not lower than $Ar_3$, the crystal grain size in the surface layer portion of the steel sheet can be adjusted so as not to make larger than the crystal grain size in the center portion of the steel sheet.

Next, the production method in the latter case will be explained.

A steel slab having a preferable composition as mentioned above is used as a starting material and subjected to a hot rolling under conditions that the slab reheating temperature is not higher than 1100° C. and the final deformation temperature is not lower than ($Ar_3$ transformation point−100° C.) but not higher than ($Ar_3$ transformation point+50° C.) as a surface temperature. By rendering the slab heating temperature into not higher than 1100° C. can be refined the γ grain size. And also, the thickness of the scale layer formed on the surface in the slab heating and during the transportation to a rolling mill after the heating can be reduced. Furthermore, the unevenness introduced onto the surface of the steel sheet in the formation of the scale becomes smaller.

That is, the scale is formed on the surface of the slab by solute elements such as Fe, Mn, Si and the like diffusing from the inside of the slab through γ grain boundary and oxygen introduced from the atmosphere (air). In this case, the higher the temperature is, the larger the diffusion rate of the solute elements of Fe, Mn, Si and the oxygen into the γ grain boundary is, and the scale largely growing at γ grain boundary is particularly formed to make the unevenness on the surface larger. When it exceeds 1100° C., the formation of the unevenness becomes remarkable and it is difficult to render the arithmetic mean roughness Ra into not more than 1.5 μm.

Therefore, when the slab reheating temperature is made to not higher than 1100° C., the surface roughness becomes smaller while the crystal grain size in the surface becomes smaller. As a result, there are obtained the effects of improving not only the anti-die-galling property but also the anti-fatigue property in the bending mode. Moreover, the slab heating temperature is more preferable to be not higher than 1050° C.

When the final deformation temperature in the hot rolling is not lower than ($Ar_3$−100° C.) but not higher than ($Ar_3$+50° C.) as a surface temperature, the crystal grain size in the surface layer portion of the steel sheet can be done so as not to make larger than the crystal grain size in the center portion of the steel sheet. When the final deformation temperature is lower than ($Ar_3$−100° C.) as a surface temperature, the ferrite transformation is promoted to form the coarse grains on the surface layer.

And also, when the final deformation temperature exceeds ($Ar_3$+50° C.) as a surface temperature, even if the slab heating temperature is made lower and the quenching is conducted after the rolling, the coarsening of the γ grains is caused even at the surface layer and it is difficult to render the ratio ds/dc in the grain size between the surface layer portion and the inside in the steel sheet into not more than 1.

After the hot rolling, the steel sheet is cooled at a rate of not less than 40° C./s to a temperature range of not higher than 750° C. but not lower than 700° C. Moreover, the term "cooling rate" used herein means an average cooling rate until the cooling is finished at the temperature range of not higher than 750° C. but not lower than 700° C. after the completion of the hot rolling. By rendering the cooling rate after the hot rolling into not less than 40° C./s, even when the final deformation temperature is not higher than $Ar_3$+50° C. even in not only the range of not lower than ($Ar_3$−100° C.) but lower than $Ar_3$ but also not lower than $Ar_3$, the growth of the recrystallized γ grains after the rolling is suppressed and a greater quantity of strain is stored in the steel, particularly, in the vicinity of the surface thereof by an effect of the supercooling to largely introduce nuclei in the transformation from γ to α and hence refine the ferrite grains. Therefore, the crystal grain size in the surface layer portion of the steel sheet can be made smaller than the crystal grain size in the center portion of the steel sheet, whereby the anti-fatigue property in the bending mode can be improved while improving the anti-die-galling property. The cooling rate after the hot rolling is preferable to be not less than 50° C./s.

Moreover, the reasons for cooling to the temperature range of not higher than 750° C. but not lower than 700° C., subsequently keeping at the temperature range for not less than 2 seconds but not more than 30 seconds, and coiling at not higher than 650° C. but not lower than 500° C. and the like are the same as mentioned above.

In addition, it is preferable in the above production method that the steel sheet after the hot rolling is subjected to a pickling to form a pickled hot rolled steel sheet. The pickling method is not especially limited and may be conducted in the usual manner. And also, before or after the pickling, a skinpass rolling (a rolling reduction: not more than about 1%) may be conducted for the correcting of the form, if necessary.

Each of steels having various compositions shown in Table 1 is rendered into a hot rolled steel sheet under conditions shown in Table 2. Moreover, the thickness of the hot rolled steel sheet is 2.7 mm and all of the hot rolled steel sheets are subjected to the pickling after the hot rolling but are not subjected to the skinpass rolling.

With respect to the thus obtained hot rolled steel sheets, the microstructure of the steel, the average crystal grain sizes of the ferrite in both the center portion of the steel sheet and the surface layer portion of the steel sheet and ratio ds/dc of them, the surface roughness Ra, and the tensile characteristics (yield strength (YS), tensile strength (TS), elongation (El), yield ratio (YR=YS/TS), anti-die-galling property, anti-fatigue property (endurance ratio (ratio of fatigue strength σw to tensile strength TS)) and the phosphatability (weight of chemical-treated coating) are investigated to obtain results shown in Table 3.

Moreover, each of the above items is evaluated as follows.

(1) Microstructure of Steel and Average Crystal Grain Size of Ferrite

The microstructure of steel is evaluated by observing a section of a test piece sampled from the hot rolled steel sheet in a direction parallel to the rolling direction over the overall thickness thereof by means of an electron microscope and conducting an image analysis of the resulting photograph to measure each texture fraction in the microstructure as a volume percentage. And also, the average crystal grain size of the ferrite is measured according to a cutting method disclosed in a method of testing the crystal grain size number of ferrite in steel shown in JIS G0552 after the shooting with the electron microscope.

Moreover, ds is an average crystal grain size of the ferrite measured in the surface layer portion of the steel sheet, i.e. in both a region from a front surface side of the steel sheet to a position corresponding to the quarter-thickness in the steel sheet and a region from a back surface side of the steel sheet to a position corresponding to the quarter-thickness in the steel sheet. And also, dc is an average crystal grain size of the ferrite measured in a region ranging from the quarter-thickness positions at the front and back surface sides of the steel sheet to a center position in the thickness, i.e. in a center portion of the steel sheet existing over a half of the overall thickness.

(2) Surface Roughness

The surface roughness of the hot rolled steel sheet in a direction of 90° with respect to the rolling direction is measured as an arithmetic mean roughness Ra according to JIS B0601.

(3) Tensile Characteristics

The tensile characteristics are measured by a tensile test using a JIS No. 5 tensile test piece sampled from the hot rolled steel sheet after the pickling in a direction of 90° with respect to the rolling direction.

(4) Anti-die-galling Property

The anti-die-galling property is evaluated by subjecting the steel sheet coated with a rust-preventive oil to a cylindrical drawing at a drawing ratio=1.8 using a cylindrical punch having a diameter of 33 mm, examining a galling state of the drawn steel sheet to a mold and using a six-stage rating method from 0 to 5 by a visual observation. Moreover, the smaller the numerical value of the rating, the better the result and the value of not more than 2 is a level with no problem.

(5) Anti-fatigue Property

The anti-fatigue property is evaluated by measuring an endurance ratio σW/TS of fatigue strength σW to tensile strength TS according to a plane bending test of perfectly alternating load (JIS Z2275) complying with a repeated bending test under completely reversed plane bending (JIS Z 2275) when stress not broken after repeated load of 107 times is a fatigue strength σW. Moreover, the larger the numerical value of the endurance ration σW/TS, the better the anti-fatigue property in the bending mode in which the target value is not less than 0.55.

(6) Phosphatability

The phosphatability is evaluated by washing and degreasing the steel sheet (mass $W_0$) as a test material, immersing in a solution containing a chemical-treating agent (zinc phosphate solution) for a given period of time, further washing, and then measuring a mass (W) to calculate a mass increment ($W-W_0$) per unit area through the adhesion of zinc phosphate crystal, i.e. a weight of a chemical-treated coating. The target value is not less than 2.0 g/$m^2$.

TABLE 1

| Kind of steel | Chemical Compositions (mass %) C | Si | Mn | Mo | Al | P | S | Other elements | $Ar_3$ Transformation point (° C.) | Remarks |
|---|---|---|---|---|---|---|---|---|---|---|
| A | 0.04 | 1.2 | 1.5 | 0.30 | 0.030 | 0.012 | 0.005 | — | 880 | Acceptable |
| B | 0.05 | 0.7 | 1.4 | 0.40 | 0.032 | 0.013 | 0.007 | Cr: 0.1, Ca: 0.002 | 860 | steels |
| C | 0.08 | 1.0 | 1.0 | 0.30 | 0.033 | 0.010 | 0.008 | REM: 0.003 | 880 | |
| D | 0.08 | 0.8 | 1.2 | 0.20 | 0.032 | 0.010 | 0.007 | Cr: 0.2 | 860 | |
| E | 0.10 | 1.0 | 1.0 | 0.30 | 0.033 | 0.010 | 0.006 | Ca: 0.003 | 870 | |
| F | 0.16 | 0.5 | 2.6 | 0.50 | 0.030 | 0.011 | 0.006 | — | 810 | |
| G | 0.01 | 1.0 | 1.4 | 0.20 | 0.032 | 0.010 | 0.008 | — | 870 | Comparative |
| H | 0.08 | 0.01 | 2.0 | 1.20 | 0.035 | 0.012 | 0.007 | Ca: 0.002 | 850 | steels |
| I | 0.10 | 2.0 | 1.5 | 0.40 | 0.035 | 0.011 | 0.020 | — | 890 | |
| J | 0.12 | 1.4 | 0.1 | 0.50 | 0.034 | 0.050 | 0.030 | REM: 0.01 | 910 | |
| K | 0.15 | 0.6 | 0.5 | 0.30 | 0.030 | 0.011 | 0.006 | — | 870 | |
| L | 0.08 | 1.2 | 1.5 | — | 0.033 | 0.011 | 0.020 | Ca: 0.01 | 860 | |
| M | 0.15 | 0.2 | 3.2 | — | 0.030 | 0.011 | 0.005 | Cr: 0.5 | 770 | |

TABLE 2-1

| No. | Kind of steel | Production Conditions SRT (° C.) | FDT (° C.) | $CR_1$ (° C./s) | T1 (° C.) | t1 (sec) | T2 (° C.) | $CR_2$ (° C./s) | CT (° C.) | $Ar_3$-100 (° C.) | $Ar_3$ (° C.) | $Ar_3$ + 50 (° C.) | Remarks |
|---|---|---|---|---|---|---|---|---|---|---|---|---|---|
| 1 | A | 1100 | 900 | 45 | 710 | 4 | 700 | 25 | 500 | 780 | 880 | 930 | Invention Example |
| 2 | A | 1200 | 830 | 25 | 710 | 3 | 700 | 20 | 630 | | | | Invention Example |
| 3 | A | 1200 | 870 | 25 | 730 | 5 | 700 | 25 | 550 | | | | Invention Example |
| 4 | A | 1200 | 850 | 20 | 750 | 3 | 730 | 25 | 520 | | | | Invention Example |
| 5 | A | 1100 | 900 | 20 | 700 | 3 | 690 | 25 | 500 | | | | Comparative Example |
| 6 | A | 1200 | 740 | 15 | 710 | 4 | 700 | 20 | 500 | | | | Comparative Example |
| 7 | A | 1200 | 850 | 25 | 720 | 7 | 700 | 30 | 450 | | | | Comparative Example |
| 8 | A | 1250 | 920 | 25 | 700 | 3 | 700 | 25 | 530 | | | | Comparative Example |
| 9 | B | 1100 | 880 | 50 | 710 | 4 | 700 | 30 | 500 | 760 | 860 | 910 | Invention Example |
| 10 | B | 1200 | 830 | 20 | 700 | 2 | 700 | 30 | 550 | | | | Invention Example |
| 11 | B | 1100 | 920 | 50 | 700 | 3 | 690 | 25 | 500 | | | | Comparative Example |
| 12 | B | 1200 | 850 | 15 | 780 | 4 | 750 | 25 | 610 | | | | Comparative Example |
| 13 | B | 1200 | 840 | 20 | 750 | 2 | 740 | 10 | 720 | | | | Comparative Example |
| 14 | B | 1200 | 810 | 25 | 680 | 10 | 630 | 20 | 520 | | | | Comparative Example |
| 15 | B | 1200 | 850 | 20 | 750 | 35 | 700 | 25 | 500 | | | | Comparative Example |

(Note)
SRT: Slab reheating temperature,
FDT: Final deformation temperature,
$CR_1$: Cooling rate after rolling (Average cooling rate from FDT to T1),
T1: Final cooling temperature after rolling,
t1: Retention time,
T2: Final temperature of retention treatment,
$CR_2$: Cooling rate after retention treatment (Average cooling rate from T2 to CT),
CT: Coiling temperature.

TABLE 2-2

| No. | Kind of steel | Production Conditions SRT (° C.) | FDT (° C.) | $CR_1$ (° C./s) | T1 (° C.) | t1 (sec) | T2 (° C.) | $CR_2$ (° C./s) | CT (° C.) | $Ar_3$-100 (° C.) | $Ar_3$ (° C.) | $Ar_3$ + 50 (° C.) | Remarks |
|---|---|---|---|---|---|---|---|---|---|---|---|---|---|
| 16 | C | 1200 | 840 | 20 | 720 | 5 | 700 | 30 | 550 | 780 | 880 | 930 | Invention Example |
| 17 | C | 1100 | 880 | 40 | 720 | 4 | 700 | 30 | 500 | | | | Invention Example |
| 18 | D | 1200 | 820 | 25 | 710 | 3 | 700 | 25 | 500 | 760 | 860 | 910 | Invention Example |
| 19 | D | 1100 | 860 | 45 | 710 | 3 | 700 | 25 | 500 | | | | Invention Example |
| 20 | E | 1200 | 830 | 20 | 730 | 4 | 700 | 25 | 550 | 770 | 870 | 920 | Invention Example |
| 21 | E | 1100 | 880 | 45 | 720 | 4 | 700 | 25 | 500 | | | | Invention Example |
| 22 | F | 1050 | 830 | 45 | 710 | 3 | 700 | 25 | 550 | 710 | 810 | 860 | Invention Example |
| 23 | F | 1200 | 790 | 25 | 710 | 3 | 700 | 20 | 520 | | | | Invention Example |
| 24 | F | 1200 | 830 | 35 | 690 | 4 | 680 | 25 | 550 | | | | Comparative Example |
| 25 | G | 1200 | 860 | 25 | 720 | 6 | 700 | 20 | 570 | 770 | 870 | 920 | Comparative Example |
| 26 | H | 1200 | 830 | 20 | 730 | 4 | 710 | 25 | 600 | 750 | 850 | 900 | Comparative Example |
| 27 | I | 1200 | 840 | 20 | 720 | 5 | 700 | 25 | 550 | 790 | 890 | 940 | Comparative Example |
| 28 | J | 1250 | 900 | 30 | 740 | 4 | 720 | 30 | 530 | 810 | 910 | 960 | Comparative Example |
| 29 | K | 1200 | 820 | 25 | 720 | 3 | 700 | 25 | 580 | 770 | 870 | 920 | Comparative Example |
| 30 | L | 1200 | 800 | 25 | 700 | 2 | 700 | 25 | 500 | 760 | 860 | 910 | Comparative Example |
| 31 | M | 1100 | 800 | 40 | 680 | 2 | 680 | 25 | 600 | 670 | 770 | 820 | Comparative Example |

(Note)
SRT: Slab reheating temperature,
FDT: Final deformation temperature,
$CR_1$: Cooling rate after rolling (Average cooling rate from FDT to T1),
T1: Final cooling temperature after rolling,
t1: Retention time,
T2: Final temperature of retention treatment,
$CR_2$: Cooling rate after retention treatment (Average cooling rate from T2 to CT),
CT: Coiling temperature.

TABLE 3-1

| No. | Kind of steel | Microstructure of steel: Ferrite fraction (vol %) | Microstructure of second phase *1 | Mertensite fraction (vol %) | Average crystal grain size: Surface layer portion ds (μm) | Center portion dc (μm) | ds/dc ratio | Surface roughness of steel sheet (μm) |
|---|---|---|---|---|---|---|---|---|
| 1 | A | 82 | M | 18 | 5.0 | 6.5 | 0.8 | 0.8 |
| 2 | A | 70 | M | 30 | 7.2 | 8.6 | 0.8 | 1.2 |
| 3 | A | 80 | M | 20 | 7.9 | 10.8 | 0.7 | 0.8 |
| 4 | A | 70 | M | 30 | 6.3 | 12.1 | 0.5 | 1.0 |
| 5 | A | 76 | M | 24 | 16.4 | 11.0 | 1.5 | 1.2 |
| 6 | A | 85 | M | 15 | 15.0 | 9.5 | 1.6 | 1.2 |
| 7 | A | 80 | B | 0 | 9.2 | 8.8 | 1.0 | 2.5 |
| 8 | A | 85 | B + M | 5 | 13.8 | 9.5 | 1.5 | 1.2 |
| 9 | B | 84 | M | 16 | 5.2 | 6.9 | 0.8 | 1.0 |
| 10 | B | 70 | M | 30 | 8.8 | 9.2 | 1.0 | 1.2 |
| 11 | B | 65 | B + M | 5 | 20.1 | 13.8 | 1.5 | 1.2 |
| 12 | B | 80 | B + M | 5 | 10.9 | 7.3 | 1.5 | 1.4 |
| 13 | B | 70 | P + B + M | 20 | 8.3 | 8.6 | 1.0 | 2.0 |
| 14 | B | 50 | M | 50 | 12.5 | 8.5 | 1.5 | 1.3 |
| 15 | B | 75 | P + B + M | 10 | 6.2 | 25.0 | 0.2 | 0.9 |

TABLE 3-1-continued

| | Evaluation of properties | | | | | | | |
|---|---|---|---|---|---|---|---|---|
| | Tensile characteristics | | | | Anti-die- | Anti-fatigue | | |
| No. | YS (MPa) | TS (MPa) | El (%) | YR (%) | galling property | property (σw/TS) | Phosphatability ($g/m^2$) | Remarks |
| 1 | 412 | 612 | 32 | 67 | 0 | 0.58 | 3.0 | Invention Example |
| 2 | 393 | 608 | 33 | 65 | 1 | 0.57 | 3.6 | Invention Example |
| 3 | 389 | 596 | 34 | 65 | 0 | 0.60 | 3.2 | Invention Example |
| 4 | 385 | 614 | 31 | 63 | 0 | 0.58 | 3.2 | Invention Example |
| 5 | 399 | 603 | 30 | 66 | 3 | 0.42 | 3.1 | Comparative Example |
| 6 | 357 | 567 | 32 | 63 | 4 | 0.47 | 3.5 | Comparative Example |
| 7 | 435 | 547 | 35 | 80 | 3 | 0.40 | 3.2 | Comparative Example |
| 8 | 468 | 610 | 30 | 77 | 3 | 0.50 | 3.2 | Comparative Example |
| 9 | 416 | 604 | 34 | 69 | 1 | 0.60 | 2.9 | Invention Example |
| 10 | 408 | 613 | 34 | 67 | 2 | 0.56 | 3.0 | Invention Example |
| 11 | 492 | 622 | 30 | 79 | 4 | 0.48 | 3.0 | Comparative Example |
| 12 | 488 | 680 | 28 | 72 | 3 | 0.45 | 2.8 | Comparative Example |
| 13 | 598 | 704 | 26 | 85 | 4 | 0.43 | 2.9 | Comparative Example |
| 14 | 402 | 688 | 29 | 58 | 3 | 0.41 | 2.7 | Comparative Example |
| 15 | 491 | 564 | 33 | 87 | 3 | 0.50 | 2.8 | Comparative Example |

(Note)
Second phase microstructure M: Martensite phase, B: Bainite phase, P: Pearlite phase

TABLE 3-2

| | | | | | Average crystal grain size | | | Surface |
|---|---|---|---|---|---|---|---|---|
| | | Microstructure of steel | | | Surface | | | roughness |
| No. | Kind of steel | Ferrite fraction (vol %) | Microstructure of second phase *1 | Mertensite fraction (vol %) | layer portion ds (μm) | Center portion dc (μm) | ds/dc ratio | of steel sheet (μm) |
| 16 | C | 85 | M | 15 | 9.5 | 11.2 | 0.8 | 1.3 |
| 17 | C | 87 | M | 13 | 9.0 | 10.8 | 0.8 | 0.8 |
| 18 | D | 90 | M | 10 | 7.9 | 9.5 | 0.8 | 1.2 |
| 19 | D | 90 | M | 10 | 7.2 | 9.0 | 0.8 | 0.7 |
| 20 | E | 85 | M | 15 | 8.3 | 8.4 | 1.0 | 1.4 |
| 21 | E | 87 | M | 13 | 8.6 | 9.0 | 1.0 | 1.0 |
| 22 | F | 75 | M | 25 | 4.5 | 5.6 | 0.8 | 1.0 |
| 23 | F | 72 | M | 28 | 4.2 | 6.3 | 0.7 | 1.1 |
| 24 | F | 70 | B + M | 5 | 16.2 | 10.2 | 1.6 | 1.3 |
| 25 | G | 90 | B | 0 | 14.6 | 14.0 | 1.0 | 1.0 |
| 26 | H | 80 | B + M | 2 | 14.2 | 9.6 | 1.5 | 0.7 |
| 27 | I | 85 | M | 15 | 10.7 | 11.5 | 0.9 | 3.0 |
| 28 | J | 70 | B + M | 10 | 8.5 | 8.6 | 1.0 | 1.3 |
| 29 | K | 50 | B + M | 15 | 8.5 | 8.8 | 1.0 | 2.2 |
| 30 | L | 70 | B + M | 5 | 9.5 | 11.7 | 0.8 | 0.8 |
| 31 | M | 75 | B + M | 5 | 13.9 | 8.4 | 1.7 | 1.8 |

TABLE 3-2-continued

| | Evaluation of properties | | | | | | | |
|---|---|---|---|---|---|---|---|---|
| | Tensile characteristics | | | | Anti-die- | Anti-fatigue | | |
| No. | YS (MPa) | TS (MPa) | El (%) | YR (%) | galling property | property (σw/TS) | Phosphatability ($g/m^2$) | Remarks |
| 16 | 422 | 630 | 31 | 67 | 1 | 0.57 | 3.3 | Invention Example |
| 17 | 421 | 620 | 31 | 68 | 0 | 0.61 | 3.2 | Invention Example |
| 18 | 399 | 603 | 32 | 66 | 0 | 0.58 | 3.2 | Invention Example |
| 19 | 397 | 592 | 31 | 67 | 0 | 0.62 | 3.1 | Invention Example |
| 20 | 384 | 598 | 31 | 64 | 1 | 0.56 | 3.3 | Invention Example |
| 21 | 408 | 591 | 32 | 69 | 0 | 0.60 | 3.2 | Invention Example |
| 22 | 691 | 1003 | 16 | 69 | 2 | 0.57 | 2.4 | Invention Example |
| 23 | 702 | 1022 | 15 | 69 | 2 | 0.58 | 2.3 | Invention Example |
| 24 | 892 | 1047 | 10 | 85 | 3 | 0.41 | 2.3 | Comparative Example |
| 25 | 429 | 541 | 36 | 79 | 3 | 0.50 | 0.8 | Comparative Example |
| 26 | 416 | 570 | 30 | 73 | 3 | 0.47 | 3.8 | Comparative Example |
| 27 | 407 | 617 | 28 | 66 | 5 | 0.42 | 2.0 | Comparative Example |
| 28 | 503 | 665 | 25 | 76 | 3 | 0.48 | 3.2 | Comparative Example |
| 29 | 640 | 725 | 23 | 88 | 4 | 0.47 | 3.6 | Comparative Example |
| 30 | 555 | 625 | 27 | 89 | 3 | 0.52 | 3.0 | Comparative Example |
| 31 | 920 | 1101 | 8 | 84 | 3 | 0.42 | 0.6 | Comparative Example |

(Note)
Second phase microstructure M: Martensite phase, B: Bainite phase, P: Pearlite phase As shown in Table 3, in all Invention Examples the tensile strength TS is not less than 590 MPa and the yield ratio YR is less than 70% and also the anti-die-galling property and anti-fatigue property are excellent and the phosphatability is good as compared with those of the other steels.

Moreover, it is confirmed that all Invention Examples have no problem in weldability though this property is not shown in the table.

Thus, there can be stably obtained high-strength steel sheets having excellent anti-die-galling property and anti-fatigue property and further excellent other characteristics such as phosphatability and the like.

The invention claimed is:

1. A high-strength hot-rolled steel sheet having excellent anti-die-galling property and anti-fatigue property, comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass % and the remainder being substantially Fe and inevitable impurities, and has a tensile strength of not less than 590 MPa, a yield ratio of less than 70%, a steel microstructure containing not less than 55 vol % of ferrite and not less than 10 vol % but not more than 40 vol % of martensite provided that a total of both is not less than 95 vol %, and a ratio ds/dc of an average crystal grain size ds of the ferrite in a region ranging from a surface of the steel sheet to a position corresponding to a quarter-thickness in the steel sheet to an average crystal grain size dc of the ferrite in a region ranging from the position corresponding to the quarter-thickness in the steel sheet to a center of a thickness in the steel sheet is $0.3<ds/dc\leqq1.0$, and a surface roughness is not more than 1.5 μm as an arithmetic mean roughness Ra.

2. A high-strength hot-rolled steel sheet having excellent anti-die-galling property and anti-fatigue property, comprising C: not less than 0.02 mass % but not more than 0.2 mass %, Si: not less than 0.2 mass % but not more than 1.2 mass %, Mn: not less than 1.0 mass % but not more than 3.0 mass %, Mo: not less than 0.1 mass % but not more than 1.0 mass %, Al: not less than 0.01 mass % but not more than 0.1 mass %, P: not more than 0.03 mass % and S: not more than 0.01 mass %, and further containing at least one selected from Cr: not more than 0.3 mass %, Ca: not less than 0.001 mass % but not more than 0.005 mass % and REM: not less than 0.001 mass % but not more than 0.005 mass % and the remainder being substantially Fe and inevitable impurities, and has a tensile strength of not less than 590 MPa, a yield ratio of less than 70%, a steel microstructure containing not less than 55 vol % of ferrite and not less than 10 vol % but not more than 40 vol % of martensite provided that a total of both is not less than 95 vol %, and a ratio ds/dc of an average crystal grain size ds of the ferrite in a region ranging from a surface of the steel sheet to a position corresponding to a quarter-thickness in the steel sheet to an average crystal grain size dc of the ferrite in a region ranging from the position corresponding to the quarter-thickness in the steel sheet to a center of a thickness in the steel sheet is $0.3<ds/dc\leqq1.0$, and a surface roughness is not more than 1.5 μm as an arithmetic mean roughness Ra.

* * * * *